US006086482A

United States Patent [19]

Voden

[11] Patent Number: 6,086,482

[45] Date of Patent: Jul. 11, 2000

[54] BILLIARD ACCESSORIES COMBINATION AND PACKAGE CONSTRUCTION

[75] Inventor: Justin L. Voden, Waukesha, Wis.

[73] Assignee: Great Lakes Dart Mfg., Inc., Muskego, Wis.

[21] Appl. No.: 09/146,573

[22] Filed: Sep. 3, 1998

[51] Int. Cl.[7] ..... A63D 15/00; B65D 69/00

[52] U.S. Cl. ..... 473/41; 206/579

[58] Field of Search ..... 473/40–41; 211/14; 217/30; 206/315.9, 316, 470–471, 579, 315.1

[56] References Cited

U.S. PATENT DOCUMENTS

| | | | |
|---|---|---|---|
| 294,200 | 2/1884 | Collender | 473/41 |
| 3,511,433 | 5/1970 | Andrerws et al. | 206/315.9 |
| 3,942,640 | 3/1976 | Hellstrom | 206/469 |
| 4,591,051 | 5/1986 | Lowmann | 473/41 |
| 4,681,223 | 7/1987 | Roberts | 206/354 |
| 4,826,163 | 5/1989 | Ellul, Jr. | 473/39 |
| 4,984,788 | 1/1991 | Harriman | 473/41 |
| 5,819,457 | 10/1998 | Parker | 40/657 |
| 5,918,393 | 7/1999 | Martell | 40/1 |
| 5,947,297 | 9/1999 | Aoki et al. | 206/705 |

*Primary Examiner*—Jeanette Chapman
*Assistant Examiner*—Mitra Aryanpour
*Attorney, Agent, or Firm*—Boyle Fredrickson Ziolkowski S.C.

[57] ABSTRACT

A billiard accessories combination and package construction is disclosed which is used to effectively display billiard or pool accessories. The billiard accessories include a billiard ball, a billiard table brush and a billiard ball rack, all of which may be marked by an indicating indicia or sports logo. The package may also include such accessories as billiard chalk. The package is designed to fittingly accommodate each of the accessories. The package has an upper section and a lower section each having a mating outer edge to allow closure and retention of the package about a hinge. The package is transparent such that any identifying indicia or sport logos located on the accessories are visible through the package. The package includes a lip section having an aperture to hang the billiard accessory combination, such as in a point of purchase display. The contents of the billiard accessory combination are prominently displayed within the package.

27 Claims, 3 Drawing Sheets

FIG. 7
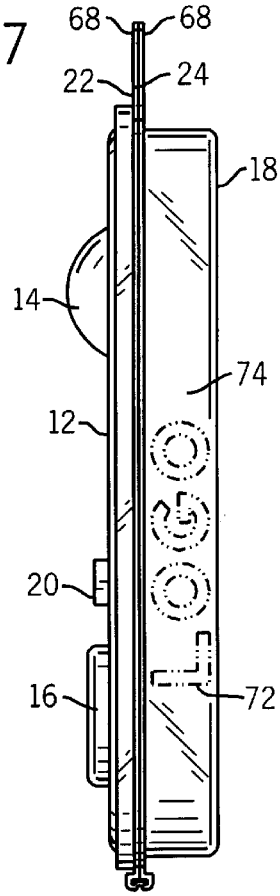
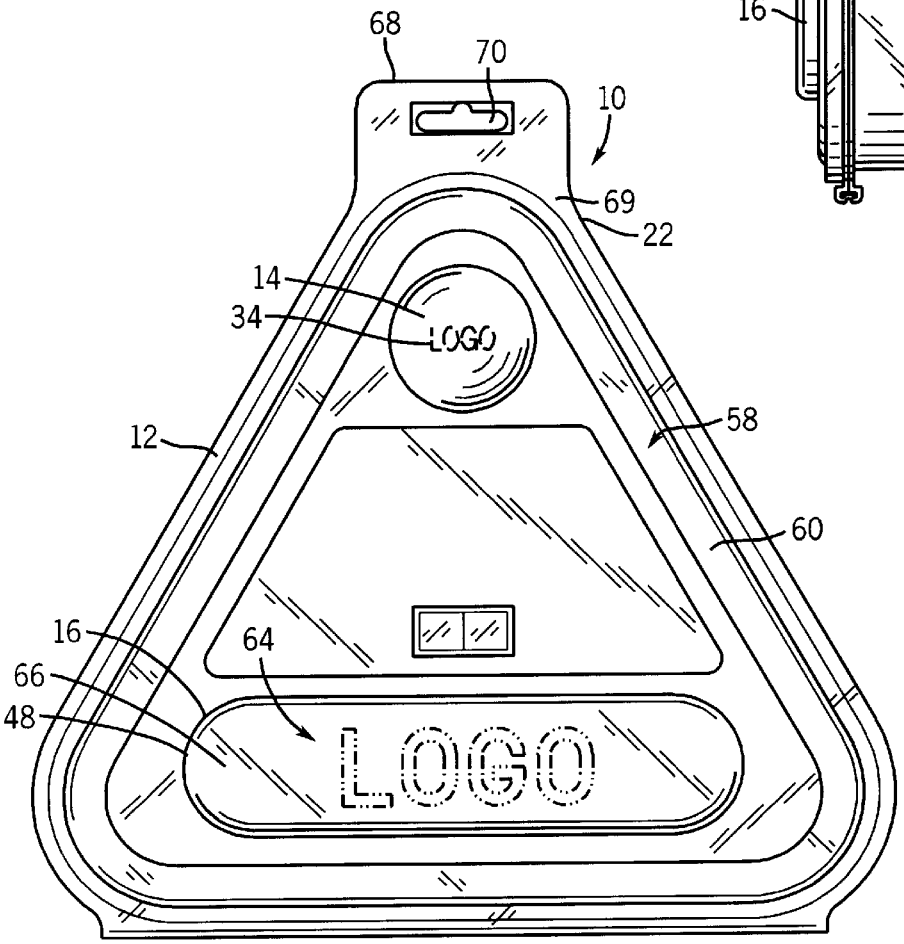
FIG. 6

BILLIARD ACCESSORIES COMBINATION AND PACKAGE CONSTRUCTION

BACKGROUND OF THE INVENTION

The present invention relates generally to billiard accessories and more particularly to a billiard accessory combination and package construction.

Various equipment and accessories are generally necessary in order to play pool or pocket billiards. Among these items are a cue ball, billiard chalk, which is used to promote friction when striking the cue ball, a billiard table brush or other felt-cleaning tool to remove debris from the felt-lined billiard table surface, and a billiard ball rack to initially place billiard balls in a proper orientation to be struck by the cue ball during the break.

It is often desirable for owners of billiard tables, or players who enjoy playing these games, to be able to purchase several accessories used in these games at the same time. It is also desirable from a marketing perspective to offer accessories which are unique as compared to the standardized equipment and to offer such accessories that are attractive to the user. It would also be advantageous to consumers to have the packaging of such equipment display the accessories and equipment in such a manner that they are not only highly visible, but that any popular or attractive logos printed on the equipment be featured at the point of purchase.

Additionally, billiards is oftentimes played at establishments where sports and sports teams are quite popular and billiard players are generally sporting enthusiasts. It would be advantageous therefore, to have popular and recognizable sports-related logos on the billiard equipment and accessories used by the patrons of these establishments. To the owners of such establishments, a package that includes billiard accessories which bear the mark of local sports teams, for example, would be highly desired.

While structures combining a rack and billiard balls are well known, such structures are generally used for storing an entire rack of billiard balls and are not constructed for the purpose of displaying other billiard accessories. An example of such a structure is found in U.S. Pat. No. 4,591,051, issued to Lowman, which discloses a billiard ball and billiard ball rack storage case.

Another example of such a structure is found in U.S. Pat. No. 4,103,773, issued to Haber, which discloses a combination package and billiard ball rack for billiard balls. However, this structure is used for a full rack of billiard balls and the structure itself is used as a billiard ball rack. The package is used for packaging billiard balls and is not capable of displaying or accommodating the various accessories associated with the game.

While the prior art discloses various billiard ball storage racks, there exists a need for a simple billiard accessories package which effectively displays its contents and provides accessories which are an attractive alternative to traditional billiard accessories. A further need exists for billiard accessories having an identifying indicia or logo thereon and a package configuration that clearly displays such indicia to a potential purchaser. Such is not disclosed by the prior art.

SUMMARY OF THE INVENTION

The present invention provides a billiard accessories combination and package construction that overcomes the aforementioned problems and can be used as a point of purchase display for various billiard accessories which are easily visible to the purchaser.

In accordance with one aspect of the invention, a billiard accessory kit is disclosed that is capable of being utilized as a point of purchase display. The billiard accessory kit contains a billiard ball, a billiard table brush, and a billiard ball rack. A billiard ball rack is positioned over the billiard table brush and the billiard ball within a transparent package. The package is formed to uniquely accommodate the billiard ball, the billiard table brush, and the billiard ball rack. Preferably, the billiard ball, the billiard table brush, and the billiard ball rack are each visible through the package.

In accordance with another aspect of the invention, a billiard accessory kit comprises a single billiard ball, a billiard table brush and a billiard ball rack, each having an identifying indicia, or logo, located thereon. The billiard accessory kit also includes a package for retaining the billiard ball, the billiard table brush, and the billiard ball rack. The package is at least partially transparent and at least one of the identifying indicia on the billiard ball, the billiard table brush and the billiard ball rack are visible through the package.

In accordance with yet another aspect of the present invention, a form fitting display package for use in retaining a billiard ball, a billiard table brush and a billiard ball rack in a stationery position is disclosed. The display package has an upper section and a lower section, each section formed with a mating outer edge to allow closure and retention of the upper section to the lower section when in a closed position. The display package further includes a hinge connecting the upper section to the lower section and allowing a one-piece construction of the display package. The display package has a ball compartment within each of the upper and lower sections. The ball compartment has a substantially hemispherical outer surface fittingly accommodating the billiard ball therein when in the closed position. The display package also has a brush compartment within the upper section. The brush compartment has a substantially rectangular outer surface in one of the upper and lower sections, and the other section has a pair of generally square outer surfaces, which are in alignment with the substantially rectangular outer surface of the other section when the upper and lower sections are in the closed position, to fittingly accommodate the billiard table brush in the display package. The display package also has a rack compartment within each of the upper and lower sections. The rack compartment has a generally triangular outer surface to fittingly accommodate the billiard ball rack therein when the display package is in the closed position.

Accordingly, one object of the present invention is to provide a billiard accessory kit which allows for the effective packaging and prominent display of a combination of billiard accessories.

Another object of the invention is to provide a billiard accessory kit which displays billiard accessories that include identifying indicia or logos located thereon.

Another object of the invention is to provide a billiard accessory kit which allows the contents of the billiard accessory kit to be seen through the package.

Yet another object of the invention is to provide a display package that is form fitted to accommodate each of the billiard accessories.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings:

FIG. 6 is a top plan view showing the packaging and the accessories in accordance with one embodiment of the present invention; and FIG. 7 is a side elevational view showing the packaging and accessories in accordance with one embodiment of the present invention.

DETAILED DESCRIPTION OF THE PREFERRED EMBODIMENT

Figure 1:
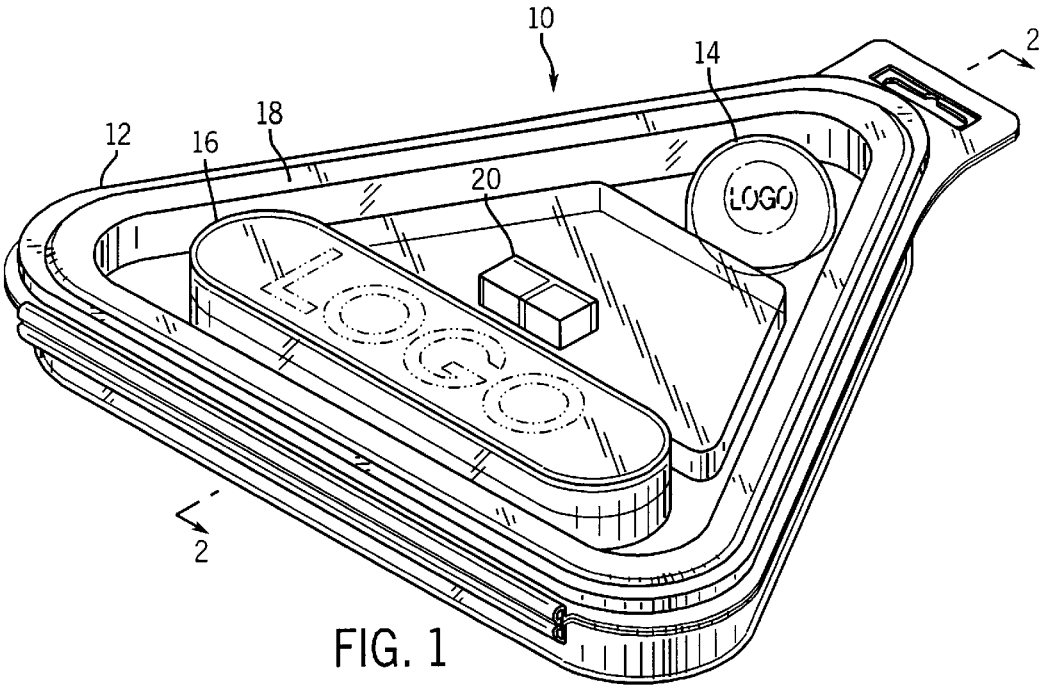
FIG. 1 is a perspective view of the billiard accessories combination and package construction in accordance with one embodiment of the present invention.

Referring to FIG. 1, a billiard accessory kit 10 is shown. The billiard accessory kit 10 includes a package 12. The package 12 is constructed generally of a molded transparent plastic material, and is shaped to house a billiard ball 14, a billiard table brush 16 and a billiard ball rack 18, which are visible from the exterior of the package 12.

In the preferred embodiment shown, the package 12 also houses billiard chalk 20. The billiard chalk 20 is shown as two pieces of standard size chalk fitted within package 12. While particular accessories are shown and are preferred, it is understood that other accessories and equipment, for example, replacement billiard stick tips (not shown) and the like, could be included within the package 12. Additionally, in the particular embodiment shown, the billiard ball 14, the billiard table brush 16, the billiard ball rack 18, and the billiard chalk 20 are not in contact with each other, although they all reside within the package 12. It is understood, however, that by varying the particular molding of the package 12, the accessories could be equivalently rearranged in a variety of configurations, for example, such that two or more of the accessories share a common portion of the package 12.

Figure 2:
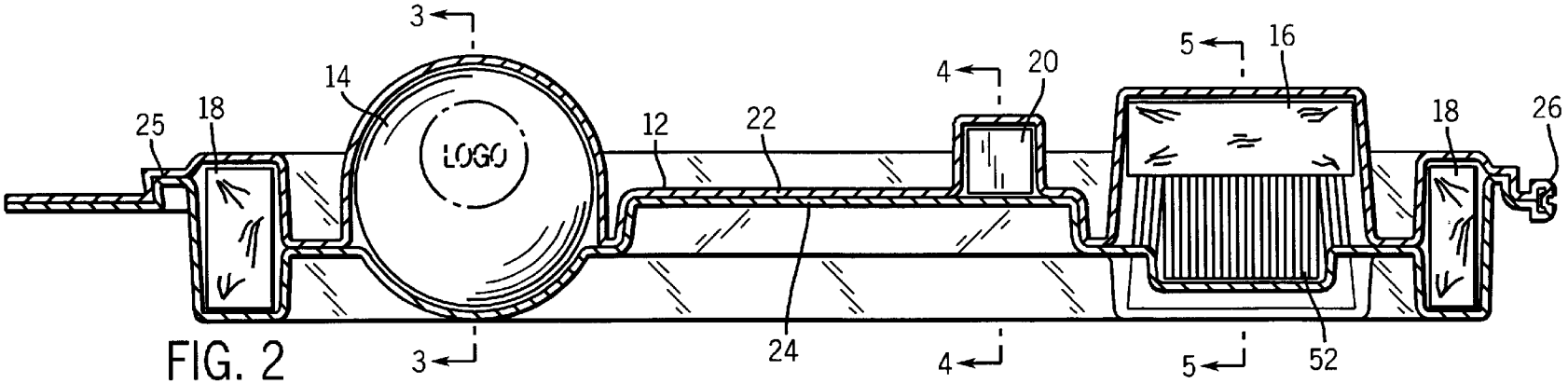
FIG. 2 is a sectional side view taken along line 2—2 of FIG. 1.

Referring now to FIG. 2, the package 12 includes an upper section 22 and a lower section 24. The upper section 22 and the lower section 24 are joined by a hinge 26. The hinge allows the package 12 to be constructed as a single assembly. The hinge 26 also permits the opening and closing of the package 12 by allowing the upper section 22 and the lower section 24 to pivot about the hinge 26 with respect to one another. The upper section 22 is retained to the lower section 24 in the closed position by a frictional fit of the lower section 24 within the upper section 22 as shown at 25. The package 12 can be opened by lifting the upper section 22 about the hinge 26 to overcome the frictional fit resistance of the upper section 22 with respect to the lower section 24. It is the meeting of the upper section 22 with the lower section 24 that creates the interior spaces necessary to accommodate the billiard ball 14, the billiard table brush 16, the billiard ball rack 18, and the billiard chalk 20.

Figure 3:
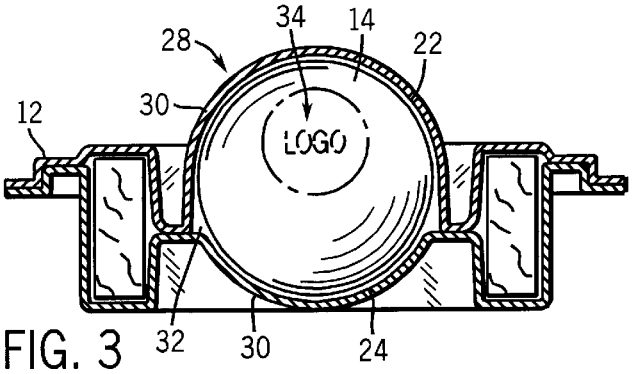
FIG. 3 is a sectional side view showing the packaging with a billiard ball therein taken along line 3—3 of FIG. 2.

Referring to FIG. 3, the package 12 includes a billiard ball compartment 28. The billiard ball compartment 28 is formed by the combination of a substantially hemispherical outer surface 30 in each of the upper section 22 and the lower section 24 about the billiard ball 14. The billiard ball compartment 28 defines an interior space 32 into which the billiard ball 14 can be placed. In the preferred embodiment shown, the billiard ball compartment 28 is sized so that the billiard ball 14 can snugly fit within the upper section 22 and the lower section 24 when in a closed position. After the billiard ball 14 is inserted into the billiard ball compartment 28, there may be some additional space. It is not absolutely necessary that the billiard ball compartment 28 mock the exact shape of the billiard ball 14. It is important only that the billiard ball 14 is reasonably accommodated within the billiard ball compartment 28.

The billiard ball 14, in general, is a standard billiard ball. Although any such billiard ball is acceptable, it is preferred that the billiard ball 14 be a cue ball. The billiard ball 14 may include an identifying indicia or logo 34, which may be located anywhere and in any size on the billiard ball 14. In a preferred embodiment, the logo 34 would be a sports team indicia which may be, for example, molded into or labeled on the billiard ball 14.

Figure 4:
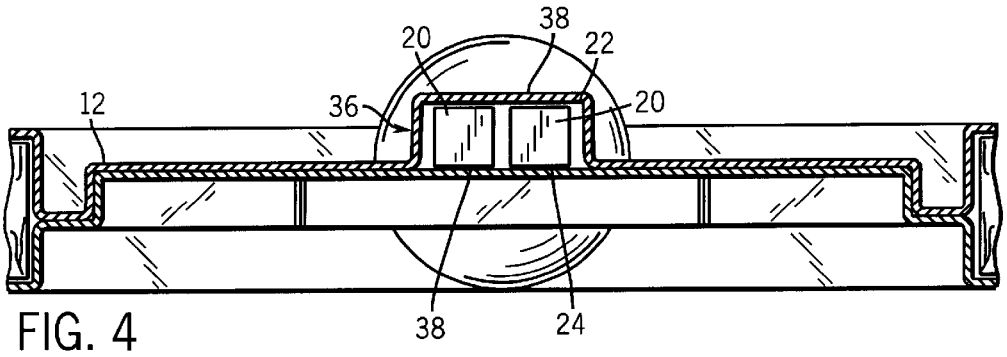
FIG. 4 is a sectional side view showing the packaging with billiard chalk therein in accordance with one is embodiment of the invention taken along line 4—4 of FIG. 2.

Referring now to FIG. 4, the billiard chalk 20 is located in the chalk compartment 36 of the package 12. The chalk compartment 36 is formed by a substantially rectangular outer surface 38 of the upper section 22 and the lower section 24 that in a closed position hold the billiard chalk 20. The size of the chalk compartment 36 is chosen to accommodate the billiard chalk 20. The chalk outer surface 38 need not mimic the exact shape of the billiard chalk 20. Rather, it is necessary only that the billiard chalk 20 be reasonably accommodated within the chalk compartment 36. The billiard chalk 20 is preferably of a standard size. Although two pieces of billiard chalk 20 are shown and preferred, it is understood that any number of pieces could be included in the package 12 by shaping the substantially rectangular outer surface 38 to accommodate the number of pieces of billiard chalk 20 desired.

Figure 5:
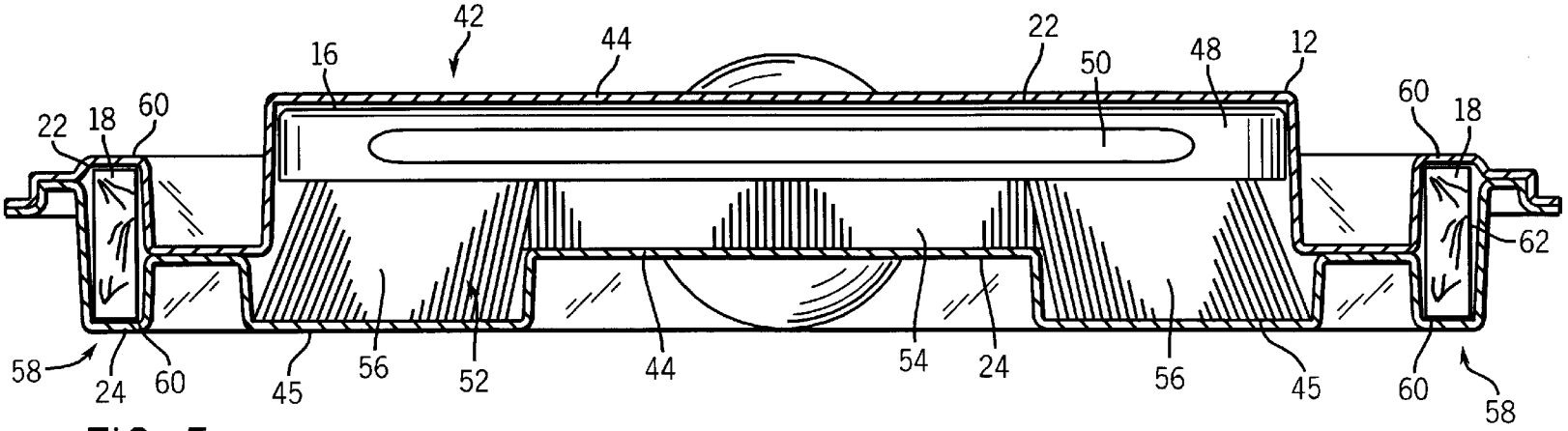
FIG. 5 is another sectional side view showing the packaging with a billiard table brush therein in accordance with one embodiment of the invention taken along line 5—5 of FIG. 2.

Referring to FIG. 5, the package 12 includes a billiard table brush compartment 42. The billiard table brush compartment 42 is defined by a substantially rectangular outer surface 44 of the upper section 22 in alignment with a pair of generally square outer surfaces 45 in the lower section 24 of the package 12. The billiard table brush compartment 42 is shaped to receive the billiard table brush 16. The size of the billiard table brush compartment 42 is such that the billiard table brush 16 can be reasonably accommodated.

The billiard table brush 16 is a felt cleaning tool of standard construction to remove debris from the felt lined surface of a billiard table (not shown). More particularly, the billiard table brush 16 includes a handle 48, in which groove 50 longitudinally extends. Extending downwardly from the handle 48 are cleaning bristles 52. The cleaning bristles 52 include one central section 54 and two side sections 56 which extend downwardly past the central section 54. Although the billiard table brush 16 is disclosed, any suitable felt cleaning tool is contemplated by the present invention.

The package 12 also includes a billiard ball rack compartment 58, which is defined by a generally triangular outer surface 60, FIG. 6, in each of the upper section 22 and the lower section 24 and which contains the billiard ball rack 18 when the package 12 is in a closed position. The outer surfaces 60 extend in a triangular fashion substantially about the perimeter of the package 12. The billiard ball rack compartment 58 is sized to reasonably accommodate the billiard ball rack 18. The billiard ball rack compartment 58 need not necessarily mimic the exact shape of the billiard ball rack 18. However, in the present invention each of the billiard accessories do fit snugly within the package.

Referring to FIG. 6, the billiard table brush 16 may include an identifying indicia or logo 64 located on a top portion 66 of handle 48. The logo 34 of the billiard ball 14 is also visible through the package 12. It should be stressed that the logo 34 of the billiard ball 14 and the logo 64 of the billiard table brush 16 may be of various sizes and be placed in different locations and orientations on the billiard ball 14 and billiard table brush 16, respectively. Generally, the logo on each accessory is of the same sports teams however.

The package 12 further includes an outwardly extending lip section 68, which extends from an outer edge end 69 of each of the upper section 22 and the lower section 24. The lip sections 68 each include an aperture 70 therein. The apertures 70 substantially line up when the package 12 is in its closed position. The apertures 70 allow the billiard accessory kit 10 to be displayed, such as from a point of purchase display, such that the contents of the billiard accessory kit 10 can be readily observed.

Referring now to FIG. 7, the outwardly extending lip sections 68 extend from both the upper section 22 and the lower section 24 of the package 12. An identifying indicia or logo 72 may be preferably placed on the side wall 74 of the billiard ball rack 18. It is important to note that the logo 72 of the billiard ball rack 18 may be the same as the logos of the billiard ball 14 and of the billiard table brush 16. They do not have to be identical, however. For example, each logo may be of a different sports team or of a particular sports event. The goal of the logos is to attract purchasers who not only purchase billiard accessories, but to attract occasional billiard players who follow the indicated sports team. Although not shown, it is contemplated that the logos may also be molded at various locations into the plastic of package 12.

The present invention has been described in terms of the preferred embodiment, and it is recognized that equivalents, alternatives, and modifications, aside from those expressly stated, are possible and within the scope of the appending claims.

I claim:

1. A billiard accessory kit comprising:

a single billiard ball component;

a billiard table brush component;

a billiard ball rack component positioned over the billiard table brush component and the billiard ball component;

a triangular-shaped package enclosing the singular billiard ball component, the billiard table brush component and the billiard ball rack component; and wherein said package has at least three interior spaces to individually accommodate each of the billiard ball component, the billiard table brush component and the billiard ball rack component in a separate fixed position within the package.

2. The billiard accessory kit of claim 1 wherein the package has an upper section and a lower section, each section formed with a mating outer edge having a friction fit to allow closure and retention of the upper section to the lower section.

3. The billiard accessory kit of claim 2 wherein the upper section and the lower section each further includes an outwardly extending lip section from an outer edge and having an aperture therein, the apertures substantially lining up when the upper section mates with lower section to permit hanging of the package.

4. The billiard accessory kit of claim 2 further comprising a hinge connecting the upper section to the lower section and allowing a one-piece construction of the package.

5. The billiard accessory kit of claim 2 wherein each of the upper and lower sections has a ball compartment having a substantially hemispherical outer surface fittingly accommodating the billiard ball component therein when in a closed position.

6. The billiard accessory kit of claim 2 wherein the one of the upper and lower sections has a brush compartment having a substantially rectangular outer surface and the other section has a pair of generally square outer surfaces in alignment with the substantially rectangular outer Surface of the other section when the upper and lower sections are in a closed position to fittingly accommodate the billiard table brush component in the brush compartment.

7. The billiard accessory kit of claim 2 wherein each of the upper and lower sections has a rack compartment having a substantially triangular outer surface fittingly accommodating the billiard ball rack component therein when in a closed position.

8. The billiard accessory kit of claim 2 wherein the package is at least partially constructed of a transparent plastic such that at least a portion of the billiard ball component, the billiard table brush component and the billiard ball rack component are visible through the package.

9. The billiard accessory kit of claim 2 further comprising at least one piece of billiard chalk and wherein the package is formed to fittingly accommodate the billiard chalk within the package.

10. The billiard accessory kit of claim 1 wherein at least one of the billiard ball component, the billiard table brush component, and the billiard ball rack component further comprises thereon an identifying indicia.

11. The billiard accessory kit of claim 1 wherein the package further includes an outwardly extending lip from an outer edge and having an aperture therein to permit hanging of the kit from a display stand.

12. A billiard accessory kit comprising:

a single billiard ball;

a billiard table brush;

a billiard ball rack having the billiard table brush and the billiard ball located therein when packaged as a kit;

indicia contained on each of the ball, the brush, and the rack; and means for containing and displaying the billiard ball, the billiard table brush, and the billiard ball rack, the means for containing and displaying having individual compartments for individually form fitting each of the billiard ball, the billiard table brush, and the billiard ball rack therein, and wherein at least the indicia of the billiard ball, the billiard table brush, and the billiard ball rack are visible therethrough.

13. The billiard accessory kit of claim 12 wherein the means for containing and displaying the billiard ball, the billiard table brush, and the billiard ball rack has an upper section and a lower section, each section formed with a mating outer edge to allow closure and retention of the upper section to the lower section.

14. The billiard accessory kit of claim 13 wherein the upper section and the lower section each further includes an outwardly extending lip section from an outer edge end and having an aperture therein, the apertures substantially lining up when the upper section mates with the lower section to permit hanging of the means for containing and displaying.

15. The billiard accessory kit of claim 13 further comprising a hinge connecting the upper section to the lower section and allowing a one-piece construction of the means for containing and displaying the billiard ball, the billiard table brush and the billiard ball rack.

16. The billiard accessory of claim 13 wherein each of the upper and lower sections has a ball compartment having a substantially hemispherical outer surface fittingly accommodating the billiard ball therein when in a closed position.

17. The billiard accessory kit of claim 13 wherein the upper section has a brush compartment having a substantially rectangular outer surface and the lower section has a pair of generally square outer surfaces in alignment with the substantially rectangular outer surface of the upper section when the upper and lower sections are in a closed position to fittingly accommodate the billiard table brush in the brush compartment.

18. The billiard accessory kit of claim 13 wherein each of the upper and lower sections has a rack compartment having a generally triangular outer surface fittingly accommodating the billiard ball rack therein when in a closed position.

19. The billiard accessory kit of claim 12 wherein the means for containing and displaying is at least partially constructed of a triangle-shaped piece of transparent plastic such that at least a portion of the billiard ball, the billiard table brush, and the billiard ball rack are visible through the means for containing and displaying.

20. The billiard accessory kit of claim 12 further comprising at least one piece of billiard chalk and wherein the means for containing and displaying is formed to fittingly accommodate the billiard chalk therein when in a closed position.

21. The billiard accessory kit of claim 13 wherein the upper section and lower section of the means for containing and displaying meet to create at least three individual interior spaces to fit the billiard ball, the billiard ball rack, and a billiard table brush.

22. A billiard accessory kit comprising:

a billiard ball having an identifying indicia located thereon;

a billiard table brush in spaced relation to the billiard ball and having the identifying indicia located thereon;

a billiard ball rack in spaced relation about the billiard table brush and the billiard ball and having the identifying indicia located thereon; and a package form-fit to snugly retain the billiard ball, and the billiard table brush, and wherein at least one of the identifying indicia on the billiard ball, and the billiard table brush are visible through the package.

23. The billiard accessory kit of claim 22 further comprising at least one piece of billiard chalk and wherein the package is formed to fittingly accommodate the billiard chalk therein.

24. The billiard accessory kit of claim 22 wherein the identifying indicia on the billiard ball, and the billiard table brush, is a team logo that is the same.

25. A display package for use in retaining a billiard ball, a billiard table brush, and billiard ball rack in a stationary position, the display package comprising:

an upper section and a lower section, each section formed with a mating outer edge to allow for a friction-fit closure and retention of the upper section to the lower section when in a closed position;

a hinge connecting the upper section to the lower section and allowing a one-piece construction of the display package;

a ball compartment within each of the upper and lower sections and having a substantially hemispherical outer surface fittingly accommodating the billiard ball therein when in the closed position;

a brush compartment within the upper section and lower sections and having a substantially rectangular outer surface in one of the upper and lower sections, and having a pair of generally square outer surfaces in the other of the upper and lower sections and in alignment with the substantially rectangular outer surface when the upper and lower sections are in the closed position to fittingly accommodate the billiard table brush in the brush compartment; and a rack compartment within each of the upper and lower sections having a generally triangular outer surface fittingly accommodating the billiard ball rack therein when in the closed position.

26. The display package of claim 25 wherein the upper section and the lower section each further includes an outwardly extending lip section from an outer edge end and having an aperture therein, the apertures substantially lining up when the upper section mates with the lower section to permit hanging of the display package.

27. The display package of claim 25 wherein the display package is at least partially constructed of a transparent plastic such that at least a portion of the billiard ball, the billiard table brush, and the billiard ball rack are visible through the display package.

* * * * *